US008017006B2

(12) United States Patent
Lopez

(10) Patent No.: US 8,017,006 B2
(45) Date of Patent: Sep. 13, 2011

(54) STORM WATER FILTRATION APPARATUS

(76) Inventor: Eudoro Lopez, Miami, FL (US)

( * ) Notice: Subject to any disclaimer, the term of this patent is extended or adjusted under 35 U.S.C. 154(b) by 0 days.

(21) Appl. No.: 12/757,837

(22) Filed: Apr. 9, 2010

(65) Prior Publication Data

US 2010/0288684 A1 Nov. 18, 2010

Related U.S. Application Data

(60) Provisional application No. 61/212,353, filed on Apr. 10, 2009.

(51) Int. Cl.
*E03F 5/06* (2006.01)
*E03F 5/14* (2006.01)

(52) U.S. Cl. ..... 210/163; 210/170.03; 404/4; 405/52; 405/60

(58) Field of Classification Search ..... None
See application file for complete search history.

(56) References Cited

U.S. PATENT DOCUMENTS 122,209 A * 12/1871 Ashman et al. ..... 210/163
232,948 A * 10/1880 Dernham ..... 210/318
440,067 A * 11/1890 Smith ..... 210/163
459,259 A * 9/1891 Shunk ..... 210/163
468,714 A * 2/1892 Whitten ..... 404/4
505,130 A * 9/1893 Ryan ..... 210/164
506,267 A * 10/1893 Sefton ..... 210/163
634,011 A * 10/1899 Mahony ..... 210/153
672,868 A * 4/1901 Banwell ..... 404/4
783,556 A * 2/1905 Van Buskirk ..... 210/163
809,201 A * 1/1906 Lutz ..... 210/314
1,178,428 A * 4/1916 Tozier ..... 210/162
1,213,624 A * 1/1917 Glenn ..... 210/162
1,220,123 A * 3/1917 Heybach ..... 210/136
1,245,903 A * 11/1917 Gross ..... 210/163
1,473,551 A * 11/1923 Gschwind ..... 404/5
1,654,246 A * 12/1927 Egan ..... 210/163
1,659,364 A * 2/1928 Kelley ..... 404/4
1,693,977 A * 12/1928 Egan ..... 210/163
2,242,192 A * 5/1941 Gordon ..... 210/164
2,305,955 A * 12/1942 Dudley ..... 210/164
2,473,279 A * 6/1949 De Witt ..... 404/4
RE23,205 E * 3/1950 Crocker ..... 210/163
2,986,232 A * 5/1961 Wiley ..... 55/410
3,587,239 A * 6/1971 Feland ..... 405/125
4,102,790 A * 7/1978 Portyrata ..... 210/293
4,198,220 A * 4/1980 Keller ..... 55/442
4,415,462 A * 11/1983 Finch et al. ..... 210/767
4,467,570 A * 8/1984 Kriegel ..... 52/12
4,594,157 A * 6/1986 McGowan ..... 210/163
RE32,248 E * 9/1986 Blecher ..... 210/163
4,952,094 A * 8/1990 Spiess et al. ..... 405/36
5,037,542 A * 8/1991 Carroll ..... 210/161
5,133,619 A * 7/1992 Murfae et al. ..... 404/4
5,232,587 A * 8/1993 Hegemier et al. ..... 210/162
5,271,191 A * 12/1993 Vahamaki ..... 52/12
5,364,535 A * 11/1994 Buckalew ..... 210/671
5,403,474 A * 4/1995 Emery ..... 210/163
5,405,539 A * 4/1995 Schneider ..... 210/747.3
5,409,602 A * 4/1995 Sorenson ..... 210/162
5,511,903 A * 4/1996 Nichols et al. ..... 405/43

(Continued)

*Primary Examiner* — Robert James Popovics

(57) ABSTRACT

A storm water filtration apparatus, at the curb inlet for a storm drain, which prevents debris and pollutants from entering the storm drain system. Water passes through the filter at an upward angle. The filter does not require replacing for maintenance, and it continues to allow water to flow into the storm drain system even when the filter is full of trash, leaves, debris, and/or other pollutants.

1 Claim, 2 Drawing Sheets

U.S. PATENT DOCUMENTS 5,562,819 A * 10/1996 Turner et al. ..... 210/85
5,632,888 A * 5/1997 Chinn et al. ..... 210/163
5,674,386 A * 10/1997 Filion ..... 210/154
5,702,595 A * 12/1997 Mossburg, Jr. ..... 210/163
5,725,782 A * 3/1998 Chinn et al. ..... 210/767
5,733,445 A * 3/1998 Fanelli ..... 210/164
5,736,035 A * 4/1998 Nurse, Jr. ..... 210/172.1
5,788,848 A * 8/1998 Blanche et al. ..... 210/162
5,820,762 A * 10/1998 Bamer et al. ..... 210/661
5,954,952 A * 9/1999 Strawser, Sr. ..... 210/164
6,015,489 A * 1/2000 Allen et al. ..... 210/131
6,017,166 A * 1/2000 Mossburg, Jr. ..... 404/5
6,080,307 A * 6/2000 Morris et al. ..... 210/163
6,099,723 A * 8/2000 Morris et al. ..... 210/170.03
6,106,706 A * 8/2000 Roy et al. ..... 210/99
6,214,217 B1 * 4/2001 Sliger, Jr. ..... 210/167.19
6,217,756 B1 * 4/2001 Martinez ..... 210/163
6,241,881 B1 * 6/2001 Pezzaniti ..... 210/155
6,338,595 B1 * 1/2002 Schollen ..... 405/125
6,402,942 B2 * 6/2002 Cardwell et al. ..... 210/155
6,511,595 B2 * 1/2003 Crompton et al. ..... 210/162
6,551,505 B2 * 4/2003 Chinn et al. ..... 210/164
6,679,994 B1 * 1/2004 Turco et al. ..... 210/767
6,709,579 B1 * 3/2004 Singleton et al. ..... 210/163
6,797,162 B2 * 9/2004 Happel ..... 210/163
6,811,708 B2 * 11/2004 Shaw et al. ..... 210/747.3
6,821,053 B2 * 11/2004 Martinez ..... 405/40
6,824,677 B2 * 11/2004 Martinez ..... 210/97
6,869,523 B2 * 3/2005 Martinez ..... 210/121
6,905,599 B2 * 6/2005 Allard ..... 210/602
6,908,549 B2 * 6/2005 Middleton et al. ..... 210/164
6,953,524 B2 * 10/2005 Woodbridge et al. ..... 210/97
6,953,529 B2 * 10/2005 Weir ..... 210/791
6,972,088 B2 * 12/2005 Yehuda ..... 210/156
6,974,540 B1 * 12/2005 Fleischmann ..... 210/163
7,066,685 B2 * 6/2006 Humphries et al. ..... 405/43
7,070,691 B2 * 7/2006 Lindemulder ..... 210/164
7,074,326 B2 * 7/2006 Singleton ..... 210/163
7,083,721 B2 * 8/2006 McClure et al. ..... 210/155
7,108,783 B2 * 9/2006 Glazik ..... 210/163
7,128,495 B1 * 10/2006 Lill et al. ..... 404/4
7,160,048 B1 * 1/2007 Fattori et al. ..... 404/4
7,179,371 B1 * 2/2007 Bistline ..... 210/163
7,195,708 B2 * 3/2007 Mullner, Jr. ..... 210/167.19
7,208,082 B2 * 4/2007 Hurst et al. ..... 210/164
7,234,894 B1 * 6/2007 Flury ..... 405/94
7,238,279 B2 * 7/2007 Saurenman et al. ..... 210/131
7,246,968 B1 * 7/2007 Priest ..... 404/2
7,270,747 B2 * 9/2007 Happel et al. ..... 210/162
7,276,156 B2 * 10/2007 Lockerman et al. ..... 210/162
7,291,260 B2 * 11/2007 Mullner, Jr. ..... 210/167.1
7,294,256 B2 * 11/2007 Happel et al. ..... 210/155
7,300,574 B1 * 11/2007 Lewis ..... 210/163
7,357,861 B2 * 4/2008 Kelley et al. ..... 210/162
D572,358 S * 7/2008 Nattrass et al. ..... D23/397
7,438,802 B2 * 10/2008 Hurst ..... 210/163
7,455,766 B1 * 11/2008 Lewis ..... 210/163
7,465,391 B2 * 12/2008 Heist et al. ..... 210/162
7,491,338 B2 * 2/2009 Nino ..... 210/747.3
7,524,414 B1 * 4/2009 Barragan ..... 210/163
7,534,355 B2 * 5/2009 Lockerman et al. ..... 210/747.3
7,549,820 B1 * 6/2009 Happel ..... 404/4
7,563,364 B2 * 7/2009 Shaw et al. ..... 210/163
D597,653 S * 8/2009 Calkins ..... D23/388
7,584,577 B2 * 9/2009 Esmond et al. ..... 52/12
7,597,810 B2 * 10/2009 Furukawa et al. ..... 210/710
7,611,304 B2 * 11/2009 Lill et al. ..... 404/4
7,662,280 B1 * 2/2010 Cooney ..... 210/164
7,682,104 B2 * 3/2010 Wassman et al. ..... 405/125
7,699,978 B2 * 4/2010 Dyer ..... 210/131
7,780,372 B2 * 8/2010 Fattori et al. ..... 404/2
7,805,890 B2 * 10/2010 Esmond et al. ..... 52/12
7,870,692 B2 * 1/2011 Gregg ..... 52/12
7,879,233 B2 * 2/2011 Shaw et al. ..... 210/164
7,914,229 B2 * 3/2011 Aubusson et al. ..... 405/36
7,922,916 B1 * 4/2011 Witt ..... 210/162
7,951,291 B2 * 5/2011 Nino ..... 210/131
2001/0023842 A1 * 9/2001 Singleton ..... 210/163
2001/0047955 A1 * 12/2001 Chinn et al. ..... 210/164
2002/0014445 A1 * 2/2002 Cardwell et al. ..... 210/163
2003/0053862 A1 * 3/2003 Shaw et al. ..... 405/40
2003/0173277 A1 * 9/2003 Shaw et al. ..... 210/163
2003/0217955 A1 * 11/2003 Strawser, Sr. ..... 210/163
2004/0069697 A1 * 4/2004 Martinez ..... 210/163
2004/0173513 A1 * 9/2004 Nino ..... 210/156
2004/0200767 A1 * 10/2004 Singleton ..... 210/163
2004/0226869 A1 * 11/2004 McClure et al. ..... 210/163
2005/0051467 A1 * 3/2005 Yehuda ..... 210/156
2005/0072738 A1 * 4/2005 Weir ..... 210/691
2006/0091049 A1 * 5/2006 Hurst et al. ..... 210/163
2006/0124519 A1 * 6/2006 Glazik ..... 210/163
2006/0124520 A1 * 6/2006 Hurst ..... 210/163
2006/0266681 A1 * 11/2006 Lockerman et al. ..... 210/163
2007/0045162 A1 * 3/2007 Hurst et al. ..... 210/163
2007/0086856 A1 * 4/2007 Lill et al. ..... 404/4
2007/0090033 A1 * 4/2007 Kelley et al. ..... 210/163
2007/0187310 A1 * 8/2007 Weir et al. ..... 210/163
2007/0215555 A1 * 9/2007 Furukawa et al. ..... 210/728
2007/0274781 A1 * 11/2007 Aubusson et al. ..... 405/36
2007/0295652 A1 * 12/2007 Kent ..... 210/164
2008/0000845 A1 * 1/2008 Lockerman et al. ..... 210/767
2008/0006568 A1 * 1/2008 Moody et al. ..... 210/164
2008/0014021 A1 * 1/2008 Flury ..... 405/94
2008/0105603 A1 * 5/2008 Hurst ..... 210/163
2008/0145150 A1 * 6/2008 Shaw et al. ..... 405/52
2008/0149544 A1 * 6/2008 Shaw et al. ..... 210/163
2008/0226390 A1 * 9/2008 Nino ..... 404/5
2008/0296211 A1 * 12/2008 Swan ..... 210/163
2009/0014371 A1 * 1/2009 Cook ..... 210/164
2009/0101591 A1 * 4/2009 Lewis ..... 210/747
2009/0114579 A1 * 5/2009 Dyer ..... 210/155
2009/0236293 A1 * 9/2009 Alvarado ..... 210/747
2010/0288684 A1 * 11/2010 Lopez ..... 210/163
2011/0049027 A1 * 3/2011 Rueda ..... 210/163
2011/0100886 A1 * 5/2011 Lill ..... 210/164
2011/0120923 A1 * 5/2011 Shaw et al. ..... 210/163

* cited by examiner

STORM WATER FILTRATION APPARATUS

CROSS-REFERENCE TO RELATED US APPLICATIONS

I claim the benefits of provisional application No. 61/212,353, filed Apr. 10, 2009.

REFERENCES SITED

| U.S. PATENT DOCUMENTS | | | |
|---|---|---|---|
| Number | Date | Inventor | US Class |
| 5,403,474 | April 1995 | Emery | 210/163 |
| 7,563,364 | July 2009 | Shaw, et al | 210/163 |

FIELD OF THE INVENTION

This invention relates to a filtration apparatus for storm water, and more specifically, to a filtration apparatus for preventing trash, leaves and other contaminants from entering storm water drainage systems by allowing water to flow through the filter in an upward angle. The filter does not clog, even with the accumulation of trash, debris and other pollutants.

BACKGROUND OF THE INVENTION

Roads and highways have curb inlets to allow storm water to run off from the road into the storm drain or sewer and into a water retention area, a body of water or a processing facility.

Trash, leaves, debris, oil and other pollutants that flow into the storm drain system through the curb inlet or other means can lead to the pollution of waterways and contribute to flooding when they clog storm drain systems. Therefore, it is important to prevent pollutants from entering the storm drain system. To prevent pollutants from entering the storm drain system, a filter is placed at the storm water curb inlet in order to filter the water passing through the curb inlet. The present filter is designed so that it does not clog, even after accumulating lots of trash and debris. It is also made so that it does not bend inward when trash and debris accumulate; therefore, it does not allow trash and debris to enter the storm water drainage system.

U.S. Pat. No. 5,403,474 to Emery discloses a curb inlet gravel sediment filter. This type of filter may cause an obstruction to streets and is susceptible to tampering and damage from vehicles. Also, the mesh material can easily clog with debris—thereby reducing the effectiveness of the filter and contributing to flooding.

U.S. Pat. No. 7,563,364 to Shaw, et al discloses a modular curb inlet filter apparatus having an internal axial tube member on which are disposed at least two disc spacers, which in turn support a cylindrical mesh frame member, which in turn supports a tubular filter fabric. Since the filter uses a filter fabric on the outside, small particles can clog the filter and prevent water from entering the drain system. This can contribute to flooding, and the filter also requires frequent maintenance.

There remains a need for improved systems for filtering materials that pass through a drain system. Existing filters are clogged when they are filled with pollutants, and this can contribute to flooding. Filters with overflow mechanisms eventually lead to clogging because the overflow mechanisms do not properly filter pollutants that will enter the drain system.

It is desirable to have an efficient and cost-effective filter that can be placed at the street curb inlet, so that water can flow into the drainage system with fewer pollutants, without causing the drain or sewer system to clog, and without obstructing streets. The filter itself also needs to operate without clogging.

SUMMARY OF THE INVENTION

The storm water filter of the present invention is designed to adapt to existing sewer and storm drain systems that have a curb inlet for storm water. The filter disclosed herein is characterized by the fact that it prevents pollutants and debris from passing through the filter, while allowing water to pass through the filter at an upward angle.

The filter has a series of openings with upward slanting, fixed fins or louvers. The fins or louvers can be placed on one or more sides of the filter, depending on the water flow needs. The upward slanting openings may be shaped from a sheet of metal or other material. Whether with fins, louvers, or other openings, the water passes through the filter at an upward angle.

Depending on the filtering needs, fins or openings are manufactured to the needed specifications. These specifications can include spacing between fins/openings, width of fins, angle of slanting, quantity of fins/louvers/openings, type of material used, and other specifications. The system of the present invention is easily cleaned and maintained if needed, and does not require replacing of the filter medium. It also continues to allow water to flow through the filter when the filter is full of trash or debris.

When the filter is placed at the curb inlet, it can be attached by conventional mounting means, mechanical fasteners, and other means known in the art. When placed at the curb inlet, the filter does not obstruct streets, and is not easily damaged by passing vehicles. Since filtration occurs at the curb inlet, there is little to no need to clean catch basins where these filters are installed.

The present invention can also be used in different embodiments. For example, it can be placed inside storm water catch basins, adjacent to storm drain pipes inside catch basins, or where water or other liquids need to be separated from solids, semisolids, or other pollutants.

The illustrations shown serve as an example of the embodiment of the present invention; however, the illustrations should not be construed as limiting the embodiments of the invention.

DETAILED DESCRIPTION OF THE ILLUSTRATED EMBODIMENT

Figure 1:
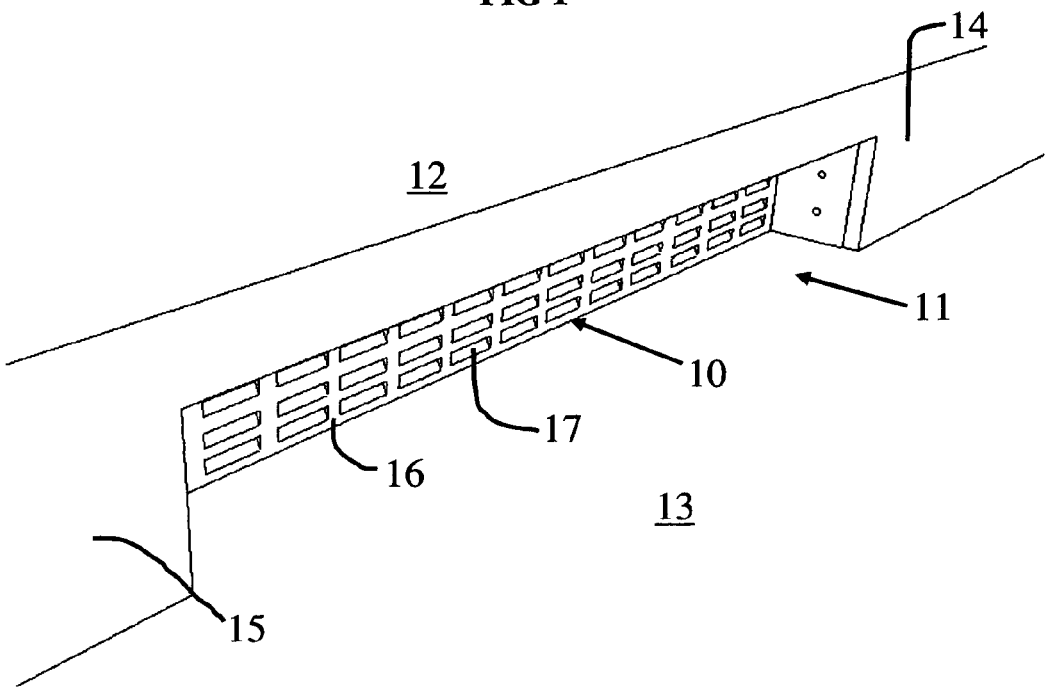
FIG. 1 is a perspective view of a storm water filtration apparatus in accordance with the present invention placed inside a curb inlet.

Turning first to FIG. 1 of the drawings, there is an illustrated embodiment of storm water filtration apparatus 10 inside a curb inlet 11 for the storm drain in curb 12. The base of inlet 11 is formed by the road 13. The curb 12 inlet 11 has inlet sides 14 and 15. The storm water filtration apparatus 10 has filtering area 16 with angled openings 17 through which storm water can pass at an upward angle as it enters inlet 11. The quantity and size of angled openings 17 and degree of the angles of angled openings 17 can vary depending on the filtration needs. Since filtration apparatus 10 is placed inside curb inlet 11, curb 12 protects it from tampering; also, filtration apparatus 10 does not obstruct roads or highways.

Figure 2:
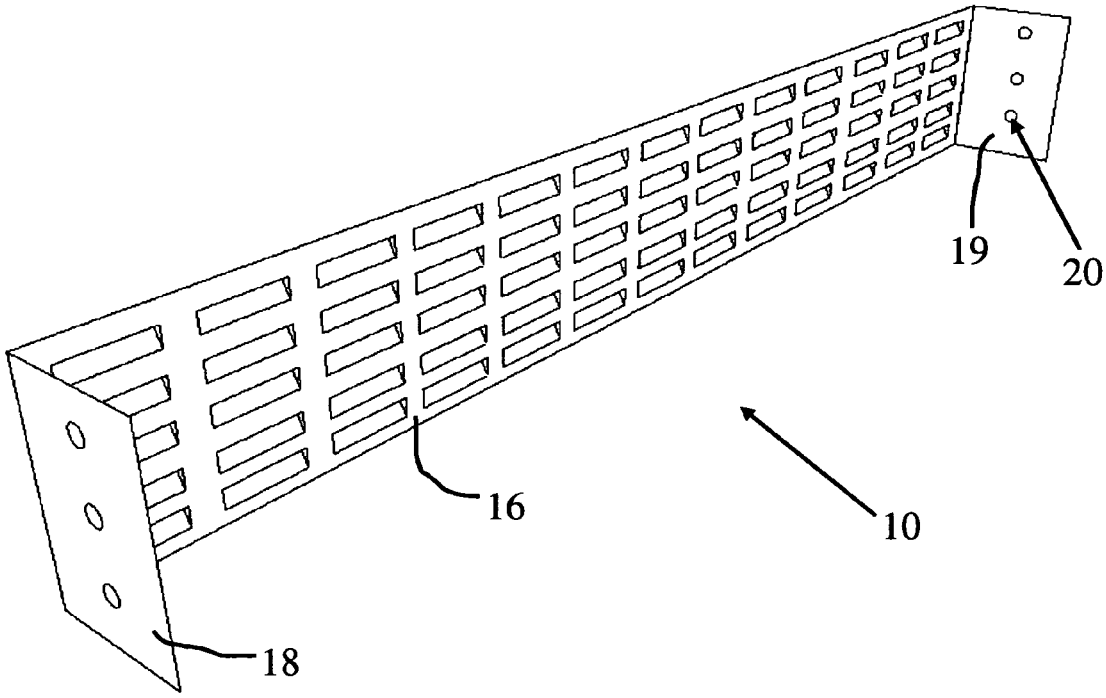
FIG. 2 is a perspective view of the storm water filtration apparatus shown in FIG. 1.

FIG. 2 shows inwardly bent flanges 18 and 19, of storm water filtration apparatus 10, attached to the ends of filtering area 16. Flanges 18 and 19 affix filtering area 16 to the inside of inlet sides 14 and 15, shown in FIG. 1. Flanges 18 and 19 can be affixed by conventional mounting means (not shown), such as welds, adhesives (e.g., glue, cement, mortar, etc.), mechanical fasteners (e.g., rivets, bolts, screws, clamps, bands, straps, etc.), and other means known in the art. Flanges 18 and 19 can include holes 20 or other opening or designs (not shown) for affixing the flanges to the inside of inlet sides 14 and 15 shown in FIG. 1. If the storm water filtration apparatus 10 needs additional strength to handle water flows or accumulation of trash and debris that can cause it to bend inward, it can be affixed to other sides of the inlet 11. This may include the road 13, the bottom of the curb 12, or another area within or near the inlet 11. The storm water filtration apparatus 10 can be attached permanently or in a way that it can be removed as needed.

Figure 3:
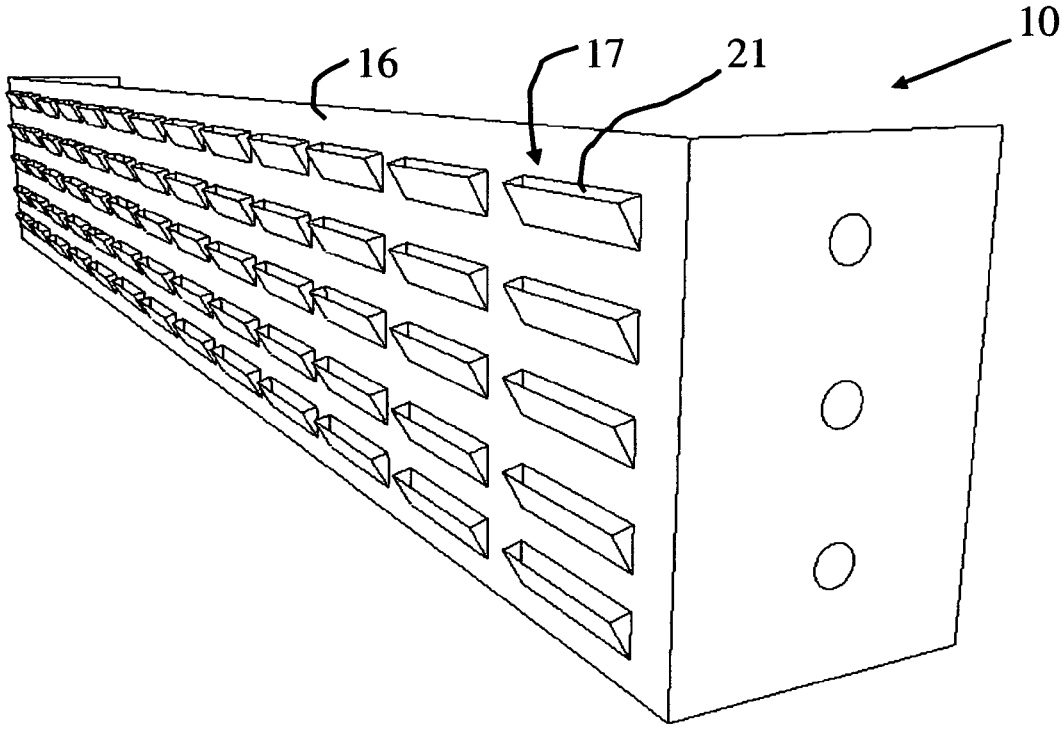
FIG. 3 is a perspective view from the rear of the storm water filtration apparatus shown in FIG. 2.

FIG. 3 shows the rear facing portion of the storm water filtration apparatus 10. The water flows at an upward angle through the open portions 21 of the angled openings 17 of the filtering area 16. Trash, debris, and pollutants do not pass through the open portions 21 of the angled openings 17. Angled opening may also be designed in different manners (not shown), as long as the water flows at an upward manner.

Figure 4:
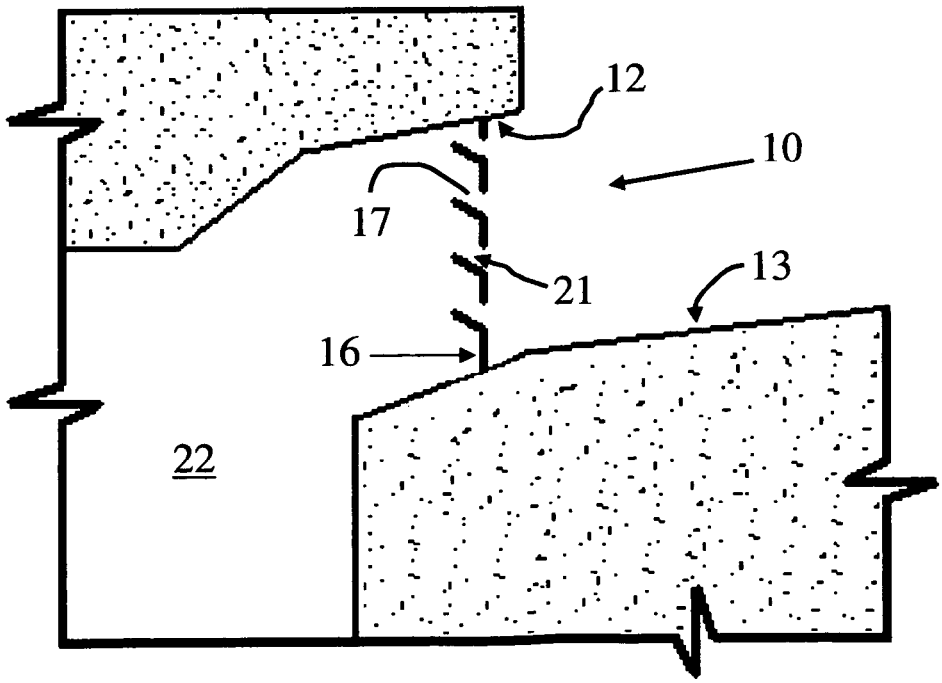
FIG. 4 is a sectional view taken through a curb inlet of FIG. 1.

FIG. 4 shows a sectional view of storm water filtration apparatus 10 placed inside curb inlet 11. The storm water filtration apparatus 10 may or may not touch the top of road 13 or the bottom of curb 12. If there is a gap between the storm water filtration apparatus 10 and the top of road 13 or bottom of curb 12, it may be filled with cement, glue, mortar, or another material. Water flows at an upward angle through angled openings 17 and enters storm water drainage area 22. Trash, leaves, debris, and other unwanted pollutants do not enter storm water drainage area 22. From storm water drainage area 22, the water can flow to various places.

I claim:

1. In a curb inlet to a storm drain, the improvement comprising:

a filtering apparatus having an elongated filtering area spanning an interior cross-section of said curb inlet and having bent mounting flanges attached to each end of said elongated filtering area, said bent mounting flanges being affixed to interior sidewalls of said curb inlet, said elongated filtering area including a plurality of angled openings having fins or louvers that, at a lower end thereof are attached to said elongated filtering area and at an upper end thereof are spaced from the plane defined by said elongated filtering area in a direction extending into said curb inlet, said bent mounting flanges extending from the plane defined by said elongated filtering area in a direction opposite to said extending direction of said fins or louvers, wherein water flowing into said curb inlet flows through the angled openings up and over said fins or louvers, while trash, debris, leaves and other pollutants are retained by said filtering apparatus which does not bend inward because of the accumulation of said pollutants.

* * * * *